US005640877A

United States Patent [19]

Danly, Sr.

[11] Patent Number: 5,640,877

[45] Date of Patent: Jun. 24, 1997

[54] HYDRAULIC PIERCING AND STRIPPING ASSEMBLY

[75] Inventor: James C. Danly, Sr., Naples, Fla.

[73] Assignee: Ready Technology, Inc., Dayton, Ohio

[21] Appl. No.: 515,122

[22] Filed: Aug. 15, 1995

[51] Int. Cl.[6] ..... B21J 7/24; B21J 9/12

[52] U.S. Cl. ..... 72/453.02; 72/453.18; 100/269.06; 83/588; 83/639.5

[58] Field of Search ..... 173/200, 201, 173/204, 121, 125; 83/639.1, 639.2, 639.5, 588; 100/266, 269.01, 269.06, 269.1, 264.1, 269.18; 72/453.02, 453.18, 307, 453.14, 441

[56] References Cited

U.S. PATENT DOCUMENTS

| | | | |
|---|---|---|---|
| 3,939,686 | 2/1976 | Walters et al. | 72/441 |
| 4,941,342 | 7/1990 | Herndl et al. | 72/453.02 |
| 5,065,609 | 11/1991 | Dischler | 72/453.18 |
| 5,271,262 | 12/1993 | Moritani et al. | 72/453.02 |

*Primary Examiner*—Scott A. Smith
*Attorney, Agent, or Firm*—Dominik & Stein

[57] ABSTRACT

The invention relates to a press driven work tool module comprising a power unit and a work unit. Each unit comprises a fluid filled cylinder, a piston for reciprocation therein, and a piston rod. Hydraulic fluid within the power stroke displacement space of the power cylinder is in communication with hydraulic fluid in the work displacement space of the work cylinder, and hydraulic fluid within the return displacement space of the power cylinder is in communication with hydraulic fluid within the return stroke displacement space of the work cylinder. The power cylinder is provided with a moving top plate connected to the power piston rod and a spring arrangement for urging the top plate and power piston rod to the return position, such that a drive force acting on the power piston rod moves the power piston and work piston to the power and work ends of the respective cylinders against the spring bias. The system is hydraulic and eliminates the need for pressurized gas, avoiding problems such as contamination, worn seals, loss of pressure over time, and need for recharging.

11 Claims, 2 Drawing Sheets

HYDRAULIC PIERCING AND STRIPPING ASSEMBLY

BACKGROUND OF THE INVENTION

1. Field of the Invention

The present invention concerns a mechanical apparatus of the type wherein a tool mounted on a reciprocating piston is used to deform a work piece. In a preferred embodiment, the present invention concerns a hydraulic piercing and stripping assembly in which hydraulic power is provided to a streamlined piercing unit for both piercing (i.e., work stroke) and stripping (i.e., return stroke), without resorting to compressed gas and without requiring complex or precise machining of either the power unit or the piercing unit.

2. Description of the Related Art

A feature common to all piercing presses is a repetitive reciprocating stroke motion, wherein a pierce stroke is followed by a stripping stroke. The pierce stroke requires considerable power in order to pierce a metal work piece. The stripping stroke must also be performed under some amount of power in order to ensure that the work tool does not remain stuck in the work piece and is completely withdrawn from the work piece.

Generally, such presses are driven by a drive force generating unit which may be, e.g., a mechanical crank and flywheel arrangement, an electric motor powered pump (see, e.g., U.S. Pat. No. 3,756,065), an electric motor powered pump connected to a hydraulic system, etc.

The press-driven tool module can be thought of as being comprised of two main components: (1) a power transmitting unit (power unit), and (2) a work unit (e.g., piercing unit). The power transmitting unit conveys the drive force from the drive force generating unit to the piercing unit. Power transmission may be by mechanical linkage, but for greater flexibility of the piercing unit power transmission is preferably by hydraulic means. In the piercing unit, the drive force is converted to a piercing stroke, usually by the action of hydraulic pressure against a work piston, which acts on a piercing ram to which a piercing tool is attached.

As discussed above, during the stripping stroke the piercing unit must be returned to the starting position under power. Various arrangements have been developed for providing this power, but each is characterized by certain inherent disadvantages.

One common means for providing return power is to connect a helical coil spring directly to the work ram. For example, U.S. Pat. No. 3,939,686 teaches a hydraulic pressure powered shear where the cutting blades are retracted by means of springs attached directly to the cutting blades. U.S. Pat. No. 3,168,918 teaches a crimping machine wherein the hydraulic ram is withdrawn under the action of a return spring. U.S. Pat. No. 5,065,609 teaches a device wherein a pressing piston is retracted directly by means of a helical coil mechanical spring. A disadvantage of these arrangements is that the helical coil spring takes up space. Space in the working area is limited, and the presence of an external spring may interfere with the range of mobility of the piercing unit in the working area. It is thus usually desirable to have the piercing unit constructed so as to be as streamlined as possible.

Alternatively, the piercing unit may be operated based upon a reciprocating piston defining a piercing chamber and a stripping chamber within a cylinder, with hydraulic power being supplied for both piercing and stripping. Stripping power may be continuous low level power, with piercing carried out against the force of the pressurized medium in the stripping cylinder space. Alternatively, piercing and stripping power may be alternated, with a piercing valve opening and a stripping valve closing to permit pressurization of the piercing chamber and a piercing stroke, and when the piercing stroke is completed, the piercing valve closing and the stripping valve opening for pressurization of the stripping chamber causing a stripping stroke.

For example, U.S. Pat. No. 5,271,262 teaches an apparatus for forging a large caliber ring. The power stroke is accomplished by hydraulic pressure, and a return cylinder device is powered by a hydraulic pressure supply source. U.S. Pat. No. 4,941,342 teaches a multi-ram forging system employing two-way rams, with hydraulic forging pressure driving the rams in the working movement, and with return being accomplished by return hydraulic pressure in a return piston chamber. Each of these systems requires a complex system of pressure accumulators, pressure regulators, control mechanisms, couplings and fittings.

PCT/DE/00370 attempts to streamline a press-driven cross-piercing or bending unit by incorporating a pressurized gas cylinder within the piercing unit, the pressurized gas providing spring power for return of the piercing unit to the starting position. More specifically, the unit comprises a work unit (including a work cylinder and a work ram slidably mounted in a horizontal cylindrical bore, the work ram adapted for receiving a work tool), a power unit (including a hydraulic power cylinder and a vertically displaceable power unit piston and piston rod mounted in the hydraulic power cylinder), the power unit being driven by a drive force generating unit (which preferably includes a flywheel and crank connected to a press ram, the press ram disposed for acting upon a power unit piston and piston rod), with a hydraulic pressure line communicating between the power cylinder and the work cylinder. The press ram acting on the hydraulic power cylinder piston rod and piston under pressure causes transmission of hydraulic fluid under pressure through the hydraulic lines to the work cylinder. Since the work unit is connected to the power unit by means of flexible high pressure lines, the work unit can be oriented and positioned independently of the power unit. This design also makes it possible to operate a multiplicity of working units via a single power unit at the same time. Further, the operation of the press-driven tool module is exceptionally simple since the hydraulic medium is essentially supplied into the power unit without any pressurization, and is essentially placed under high pressure for only short periods of time when acted upon by the drive force generating unit.

Although this design provides a number of advantages, there are also certain inherent features which are less than optimal. For example, one disadvantage of this type of hydraulic piercing unit is the need for complex and precise machining of the gas cylinder which provides the return (stripping) power. Further, the added pressurized gas system is liable to problems such as contamination, worn seals, loss of pressure over time, need for recharging, need for lubrication, etc. Further yet, the amount of return force which can safely be provided by a pressurized gas system is limited, and for certain applications compressed gas will not safely provide the required return forces.

It is an object of the present invention to provide a hydraulic piercing unit wherein a significant amount of power can be provided in the return stroke, e.g., for insuring that a mechanical piercing or bending tool is completely withdrawn from the work piece after the work operation.

A further object of the invention is to provide a hydraulic power return unit wherein no separate complex return power generating unit is required, i.e., no separate motor or accumulator or control system.

A further object of the invention is to provide a hydraulic piercing unit wherein the piercing unit can be positioned and oriented independently of the power transmitting unit.

It is an object of the invention to provide a device in which the stripping mechanism is simple in construction. The stripping mechanism should use the same hydraulic power as the piercing mechanism. The stripping mechanism should not employ compressed gas.

Finally, it is an object of the invention to provide a piercing unit which efficiently utilizes power from the drive force generating unit to power the return stroke.

SUMMARY OF THE INVENTION

The present invention improves the press-driven tool modules of the type known in this art such that they no longer suffer from the above-described disadvantages. The invention will be described in detail using a piercing and stripping tool module by way of example, but it will be readily understood that the invention is equally applicable to any number of press driven work tool modules.

The press driven work tool module is driven by a drive force generating unit, preferably a motor driven flywheel connected eccentrically to a press ram, with the press ram disposed for acting upon a power unit piston rod and piston. This is a preferred, but not limiting, means for providing impulse power to the power unit.

The power unit includes, as expected, a hydraulic power cylinder and a therein guided piston and piston rod. The power unit of the present invention is, however, characterized by (1) the provision of compression type helical coil springs for urging the power piston in the return or starting position, and (2) the power piston being a double-acting piston, i.e., having a work (piercing) power side and a return (stripping) power side, both of which are coupled to the double acting work unit. This arrangement results in the helical coiled springs powering the return stroke of the work unit.

The work unit, which by way of example may be a piercing and stripping unit, includes a work cylinder having a bore (preferably a horizontal cylindrical cylinder bore), a double-acting work piston slidably mounted within the cylinder bore, and a piston rod adapted for receiving a work tool. With reference to FIGS. 1 and 2, during the power stroke the power piston is urged downwardly, pressurizing hydraulic fluid on the work side of the power piston and also compressing the helical coil springs to store energy. This pressurized hydraulic fluid is transmitted to the work side of the work piston, where it powers the work stroke. Again with reference to FIGS. 1 and 2, for the return or stripping stroke the mechanical helical springs of the power unit urge the power piston upwardly, generating hydraulic pressure to the return or stripping side of the power piston. This return (stripping) hydraulic power is communicated to the return (stripping) side of the work piston in the work unit, and there provides the power for the return or stripping stroke.

The advantages of the above include the fact that the system is "pure hydraulic" and eliminates the need for pressurized gas, avoiding problems such as contamination, worn seals, loss of pressure over time, need for recharging, etc. The system is also simpler and less expensive to manufacture since there is no need to provide gas seals which require special provisions for routine addition of lubricants to prevent them from degrading or possibly damaging mating surfaces.

Further, in the piercing work area space is at a premium. As discussed previously, placing a return spring directly on the work unit consumes space. It is thus a significant advantage to locate the return spring in the power unit according to the present invention where more space is available.

Further yet, mechanical spring pressure is safer than high pressure gas, and is certain to be available even after the device has not been in use for months or years. Mechanical springs also make it possible to engineer higher return forces, and can provide twice the operating pressures that would be safely available with compressed gas. Finally, the "pure" hydraulic system remains better lubricated.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other press driven work tool modules for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

The invention will now be further discussed with respect to the figures in which an illustrative example according to the invention is schematically represented. Further advantages are also to be from the details. There are shown.

DETAILED DESCRIPTION OF THE INVENTION

Figure 1:
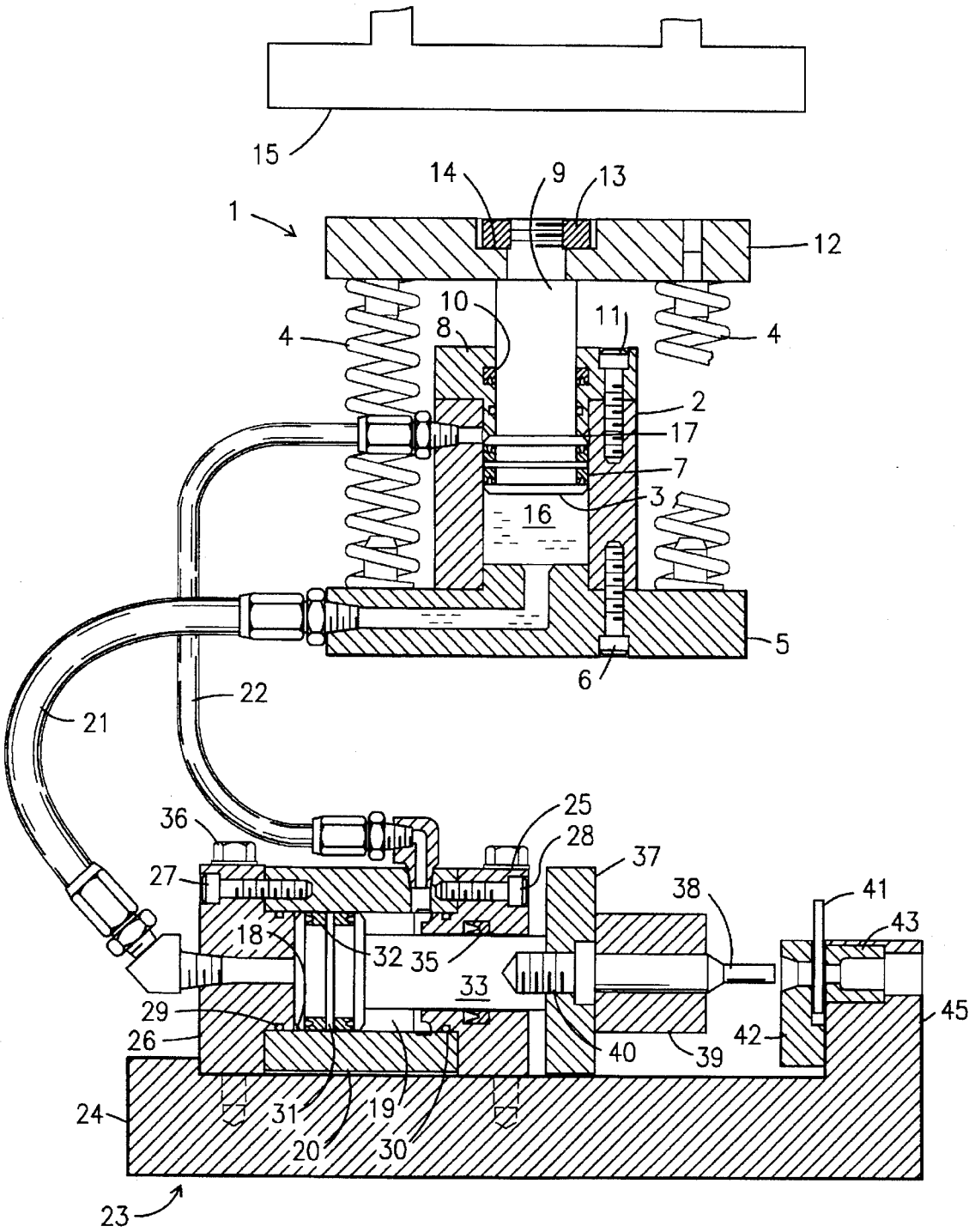
FIG. 1 a cross-sectional representation of the work tool module, with the power piston at top dead center.

The present invention is broadly applicable to any mechanical apparatus wherein a tool mounted on a reciprocating hydraulic piston is used to deform a work piece. The present invention is applicable to, for example, any apparatus for stamping or forging (wherein a ram head or hammer transfers impact energy to the work piece and the degree of deformation of the work piece is dependent upon the amount of impact energy involved), press forming (wherein a ram exerts a pressure on a work piece and the degree of deformation or shaping as a consequence of ram travel is dependent upon the press force exerted), swaging, extrusion, coining, deep drawing, shearing, piercing, and/or compacting of pulverulent ceramics and metallic powers.

Common to all these processes is that the work tool is mounted on a reciprocating ram such as a piston and piston rod unit, i.e., such that the work tool is imparted a work stroke and a return stroke. The invention will hereafter be illustrated in detail by way of a preferred piercing press as illustrated in the figures, but it will be readily understood that the invention is applicable to other types of presses including those mentioned above.

The drive force is preferably provided by a motor driven flywheel connected eccentrically to the a press ram 15 (not fully shown), with the press ram 15 disposed for acting upon a power unit piston rod 9 and piston 3. This is a preferred, but not limiting, means for providing impulse power to the power unit. However, the drive force may be provided by other means, such as disclosed in DE 26 00 948 B2, wherein an electro-motor provides motive force for pressurizing hydraulic fluid, which acts upon a reciprocating (two-way) piston such that both the piercing and the stripping stroke are accomplished under power. In order to apply static pressure for the press driven cross-piercing or bending process, DE 26 00 948 B2 discloses an expensive construction in which high pressure is achieved by means of a controlled impact type helper piston which releases staggered energy. Obviously, a simple by a motor driven flywheel connected eccentrically to the a press ram has advantages of simplicity of manufacturing and maintenance cost.

The power unit i according to the present invention is double-acting. The power unit includes a hydraulic power cylinder 2 fixedly mounted on a base plate 5 by any means of fastening, such as cap screws 6. "O"-ring seals are preferably provided within the contact area between the base plate 5 and the power cylinder 2 for providing a hydraulic seal. A power piston 3, conventionally oriented as in FIG. 1 for vertical displacement, is sealingly guided within the hydraulic power cylinder 2. Piston seals 7 may be provided within annular recesses on the outer circumscribing face of the piston 3, but it will be understood that since hydraulic medium is provided on either side of the piston, a small amount of leakage will not pose any problem, and thus it is not necessary to take great care to form an absolute hydraulic fluid-tight seal.

While the lower end of the power cylinder 2 is closed off by base plate 5, the upper end of cylinder 2 is closed off by cylinder cap 8. Cylinder cap 8 may be secured to power cylinder 2 by any means such as cap screws 11. A bore hole is provided in the cylinder cap 8 for guiding a piston rod 9, which is connected to and proceeds vertically upwards from power piston 3. A piston rod seal 10 is provided in an annular recess between the cylinder cap 8 and the piston rod 9.

The upper end of piston rod 9 is attached to a movable top plate 12 by any means for fastening these two parts. Preferably, the top plate is provided with a centrally-located stepped bore hole having a lower diameter corresponding to the diameter of the upper end of the piston rod 9, and a counterbore or recess sufficient for inserting and tightening a retaining nut 13, against the shoulder step 14 formed between the smaller diameter bore and the larger diameter counterbore. External threads are machined into the upper end of piston rod 9, such that piston rod 9 can be inserted through the lower bore segment. Retaining nut 13 is screwed onto the threading of the piston rod 9 with the lower surface of retaining nut 13 contacting step 14 between the lower bore hole and upper bore hole. Helical springs 4 urge top plate 12, and more specifically shoulder 14, upwards under mild preload compression against retaining nut 13. Retaining nut 13 acts as a stop, preventing upward movement of the top plate 12 relative to the power piston rod 9. The upper end of retaining nut 14 is flush with the upper end of the power piston rod 9. The upper surfaces of the top plate 12, the retaining nut 13, and the piston rod 9 thus align to form a planar surface which can be acted upon by the press ram 15 of the drive force generating unit.

The power piston 3 divides the cylinder displacement into a lower displacement space 16 and an upper displacement space 17. The lower displacement space 16 of the power cylinder is connected to the piercing stroke displacement space 18 of the piercing cylinder 20 via high pressure hydraulic hose 21. The upper displacement space 17 of the power cylinder is connected to the stripping stroke displacement space 19 of the piercing cylinder via high pressure hydraulic hose The piercing and stripping unit 23 according to the present invention is also double-acting. The piercing and stripping unit includes a piercing cylinder 20 rigidly connected, either directly or indirectly, to a foundation or frame 21. As shown in FIG. 1, the ends of the piercing cylinder 20 are covered by end caps 26. The end caps 25, 26 are securely attached to the piercing cylinder 20 by any fastening means, such as cap screws 27, 28, and to the foundation 21 by means of mounting bolts 36. "O"-ring seals 29, 30 are preferably provided within the contact area between the end caps 25, 26 and the piercing cylinder 20 for providing a hydraulic seal. A piercing piston 31, conventionally oriented as in FIG. 1 for horizontal displacement, is sealingly guided within the piercing cylinder 20. Piston seals 32 may be provided within annular recesses on the outer circumscribing face of the piercing piston 31, but it will be understood that hydraulic medium is provided on either side of the piston, and thus it is not critical to form an absolute hydraulic fluid tight seal.

The piercing piston 31 divides the cylinder displacement into a piercing stroke displacement space 18 which is expanded during the piercing stroke, and a stripping stroke displacement space which is expanded during the stripping stroke. The piercing stroke displacement space 18 of the piercing cylinder 20 is connected to the lower displacement space 16 of the power cylinder 2 via high pressure hydraulic hose 21. The stripping stroke displacement space 19 of the piercing cylinder 20 is connected to the upper displacement space 17 of the power cylinder via high pressure hydraulic hose The piston side of the piercing unit 23 cylinder 20 is closed off by cylinder cap 26. High pressure hydraulic hose communicates with the piercing stroke displacement space 18 of the piercing cylinder 20.

The sliding path of the piercing piston 31 is limited by abutment against the end caps 25, 26. The piercing side of the piercing piston 31 is provided with a piston rod 33 which extends axially in direction of displacement, and extends through end cap 25. Piston rod seal 35 is provided in an annular recess in end cap 25. The end of piston rod 33 which extends through end cap is adapted for receiving a tool plate 37 which is connected to the piston rod 33 by means of retaining bolt 40. Piercing punch 38 is mounted and locked in punch retainer 39 which is mounted on a tool plate 37 by means of screws (not shown). Frame 24 is provided with an upright 45 for securely holding die button 43. Work piece 41 is placed between stripper plate 42 and die button 43, and can be punched through by punch 38 during the punch stroke.

Figure 2:
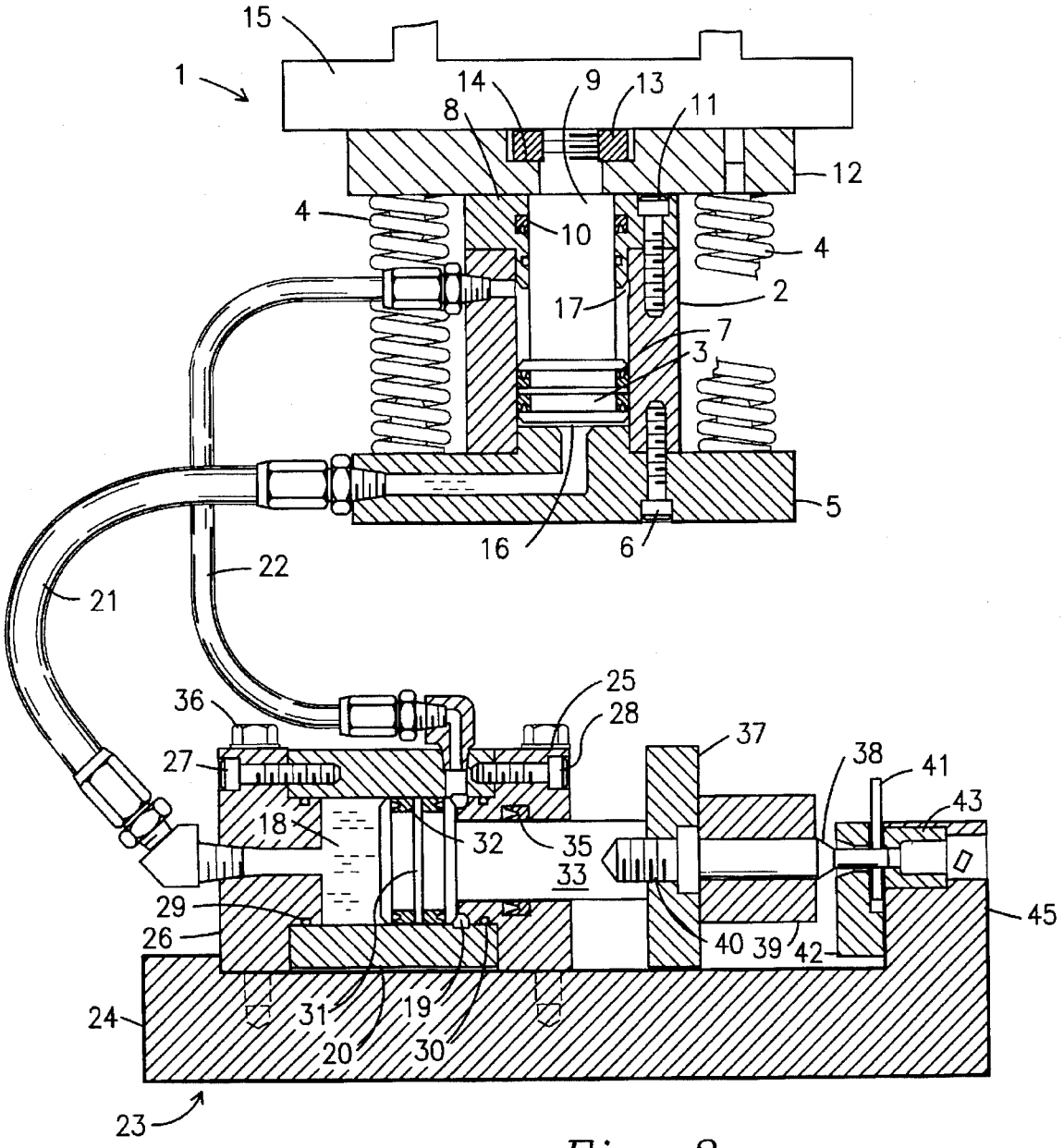
FIG. 2 is a cross-sectional representation of the work tool module of FIG. 1, with the power piston at bottom dead center.

The operation of the work tool module according to the present invention will now be explained by reference to the piercing and stripping unit constructed as discussed above. FIG. 1 shows the work tool module according to the present invention with the power piston 3 at top dead center and the work piston 31 in the starting position. Drive force generating means, such as the motor driven flywheel with eccentric crank, is energized to cause the press ram 15 to descend and act upon a power unit piston rod 9. Power unit piston rod 9 in turn urges piston 3 downward, exerting pressure on hydraulic medium in lower displacement space Hydraulic fluid under pressure is transmitted thorough high pressure hose 21 into work displacement space 18, where it acts upon the piercing stroke side of piercing piston 31 forcing it to travel until piercing piston 31 abuts against end cap 25. Since piercing piston 31, piston rod 33, tool plate 37, punch retainer 39, and piercing punch 38 are all connected, they move as a unit, and movement of piercing piston 31 results in a corresponding movement of piercing punch 38 which, as shown in FIG. 2, results in a piercing of work piece 41. At the same time, hydraulic fluid is forced from the ram side of the piercing piston 31 through high pressure hose 22 and into upper displacement space 17. At the same time that the power piston 3 and piston rod 9 are moved downwardly, the helical compression springs 4 are also compressed to store energy for powering the return stroke.

After the piercing stroke comes the stripping stroke. At the beginning of the stripping stroke the work tool module is configured as shown in FIG. 2. Helical compression springs 4 are compressed, and exert resilient force upwards against movable top plate 12. Hydraulic fluid is present in upper displacement space 17. As press ram 15 is withdrawn, springs 4 urge moving top plate 12 upwards. Moving top plate 12 is connected to retaining nut 13, which is connected to piston rod 9. As piston rod 9 is caused to move upwards, it also moves piston 3 upwards, placing the hydraulic fluid in upper displacement space 17 under pressure. This hydraulic fluid under pressure is forced through high pressure hose 22 and into the stripping stroke displacement space 19 of the piercing cylinder 20, where it acts upon the stripping side of piercing piston 31 forcing it to travel to the starting position as shown in FIG. 1. By forcing piston 31 to return to the starting position, piercing punch 38 is withdrawn from die button 43 and work piece 41 to accomplish the stripping stroke. Stripper plate 42 retains work piece 41 as piercing punch 38 is withdrawn.

Obviously, the upper displacement space 17 of the power unit is equal to the stripping stroke displacement space 19 of the piercing cylinder 20. Likewise, the lower displacement space 16 of the power cylinder corresponds to the piercing stroke displacement space 18 of the piercing cylinder 20.

The helical coil springs 4 shown above for providing the power for the return or stripping stroke may be replaced by any equivalent means, such as rubber bumpers, hydraulic springs, pneumatic springs, etc., but for ease of construction and maintenance, and for reduced cost, helical coiled metal springs are preferred.

In order to provide long life and reliable service, the fluid lines and passageways should be designed to limit the flowing speed of the hydraulic fluid to 15 feet per second to avoid heating the fluid, and the springs should meet the manufacturers recommendations for long life. A safety relief valve (not shown) should be provided to limit the pressure on the downstroke of the power unit to the safe working pressure of high pressure hose or tubing, probably 400 Bar or 6,000 pounds per square inch. Pressure on the return stroke will be safely limited by the pressure available from the springs.

Although the novel work tool module was discussed above using a piercing and stripping assembly by way of example, it will be readily apparent that the invention is capable of use in a number of other applications. Although this invention has been described in its preferred form with a certain degree of particularity with respect to a piercing and stripping work tool module, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. A press driven work tool module comprising:

a power unit comprising a hydraulic fluid filled power cylinder defining a displacement space, a power piston sealingly guided within the hydraulic power cylinder for reciprocating between a power end and a return end of said cylinder and separating the displacement space into a power stroke displacement space and a return stroke displacement space, a piston rod attached to said power piston and extending though the return stroke displacement space and through a guide bore hole extending through a closed end of said power cylinder, a work unit comprising a hydraulic fluid filled work cylinder defining a displacement space, a work piston sealingly guided within the hydraulic work cylinder for reciprocating between a work end and a return end of said cylinder in response to application of fluid pressure to opposite sides of said piston and separating the displacement space into a work stroke displacement space and a return stroke displacement space, and a piston rod attached to said work piston and extending though the return stroke displacement space and through a guide bore hole extending through a closed end of said work cylinder and adapted for receiving a work tool on the external end thereof, wherein the hydraulic fluid within said power stroke displacement space of said power cylinder is in communication with the hydraulic fluid in said work stroke displacement space of said work cylinder, and the hydraulic fluid within the return stroke displacement space of the power cylinder is in communication with the hydraulic fluid within the return stroke displacement space of the work cylinder, and wherein said power cylinder is provided with a movable top plate connected to the power piston rod and with spring means for urging said moving top plate and the thereto connected power piston rod to the return position, such that a drive force acting upon the power piston rod can move the power piston to the power end of the cylinder against the force of the spring means and therewith also moves the work piston to the work end of the work cylinder, and wherein removal of the drive force results in the spring means returning the power piston and therewith the work piston to the return ends of the respective cylinders.

2. A press driven work tool module as in claim 1, wherein said spring means are helical metal compression springs.

3. A press driven work tool module as in claim 1, wherein the lower end of the power cylinder is closed off by a base plate, the upper end of the power cylinder is closed off by a cylinder cap, and a bore hole is provided in the cylinder cap for sealingly guiding the power piston rod.

4. A press driven work tool module as in claim 3, wherein a piston rod seal is provided in an annular recess between the cylinder cap and the power piston rod.

5. A press driven work tool module as in claim 1, wherein the moveable top plate is provided with a centrally-located stepped bore hole having a smaller diameter bore corresponding to the diameter of the upper end of the piston rod, and a counterbore having a diameter sufficient for inserting and tightening a retaining nut, with a shoulder formed between the smaller diameter bore and the counterbore, wherein external threads are machined into the upper end of the power piston rod, such that the power piston rod can be inserted through the smaller diameter bore with close tolerance, and wherein a retaining nut can be screwed onto the threading of the power piston rod with the lower surface of the retaining nut contacting the shoulder between the smaller diameter bore and the counterbore.

6. A press driven work tool module as in claim 5, wherein helical springs urge the top plate upwards against the retaining nut.

7. A press driven work tool module as in claim 5, wherein the upper end of the retaining nut is flush with the upper end of the power piston rod and with the top of said movable top plate, such that the upper surfaces of the top plate, the retaining nut, and the piston rod align to form a planar surface adapted for receiving a press ram of a drive force generating unit.

8. A press driven work tool module as in claim 1, wherein the hydraulic fluid communication between said displacement spaces is by means of high pressure hydraulic hoses.

9. A press driven work tool module as in claim 1, wherein said work unit is a piercing and stripping unit, and wherein said work cylinder is rigidly connected to a frame.

10. A press driven work tool module as in claim 9, wherein the end of the work piston rod extends through a cylinder end cap and is adapted for receiving a tool plate which is connected to a punch retainer.

11. A press driven work tool module as in claim 9, wherein said foundation frame is provided with an upright for securely holding a die button and a stripper plate.

* * * * *